United States Patent [19]

Sherrow

[11] Patent Number: 4,607,752

[45] Date of Patent: Aug. 26, 1986

[54] PAINT BRUSH CLEANING RACK

[76] Inventor: Lionel Sherrow, 737 Dale Rd., Huntingdon Valley, Pa. 19006

[21] Appl. No.: 519,961

[22] Filed: Aug. 3, 1983

[51] Int. Cl.[4] ..... A47F 7/00

[52] U.S. Cl. ..... 211/65; 211/70.6; 248/110

[58] Field of Search ..... 211/65, 66, 87, 88, 211/70.6, 60.1; 248/110, 111

[56] References Cited

U.S. PATENT DOCUMENTS

| | | | |
|---|---|---|---|
| 2,080,655 | 5/1937 | Crawford | 211/65 X |
| 2,310,533 | 2/1943 | Lindell | 211/65 |
| 2,642,999 | 6/1953 | McPherson | 211/65 |
| 2,852,144 | 9/1958 | Reno | 211/65 |
| 3,536,285 | 10/1970 | Vaughn | 248/110 X |
| 3,980,264 | 9/1976 | Tomasik | 248/110 X |
| 4,286,717 | 9/1981 | Liesinger | 248/110 X |
| 4,327,837 | 5/1982 | Ross | 211/87 |

*Primary Examiner*—Robert W. Gibson, Jr.

[57] ABSTRACT

A rack includes means for suspending dirty paint brushes in disposable cups containing cleaning fluid. The number and location of brushes and cups may be varied so that different sizes of brush, containing different color paint and paint bases can be cleaned simultaneously in different solvents.

5 Claims, 3 Drawing Figures

PAINT BRUSH CLEANING RACK

BACKGROUND OF THE INVENTION

It is well known that cleaning paint brushes is necessary after each use in order to preserve them. To effectively clean brushes with paint in their fibers, they must be immersed and soaked in an appropriate cleaning fluid which acts as a paint solvent.

The problem in doing this routinely is finding an empty, clean, properly sized container, and a device for holding and suspending the brush in it. Recleaning and storing said container is also necessary if one wishes to use it again.

Inventions for racks which make cleaning paint brushes easier are usually of the type where a rack for holding brushes can be temporarily attached to a container for holding cleaning fluid, usually an empty paint can, so that the brush fibers are suspended in the fluid until the paint is softened and falls away from said fibers to the bottom of the container.

U.S. Pat. No. 2,852,144 describes one such rack comprising two rods for clinching a paint brush and suspending it in a can. U.S. Pat. No. 2,310,533 describes a rack which may be adjusted to attach to different sizes of container. It is also equipped with clamps for holding several brushes simultaneously. U.S. Pat. No. 3,536,285 describes a bracket which clips onto the side of a can and will adjustably suspend a brush inside it. U.S. Pat. No. 2,080,655 describes a container subdivided by rows of perforated plates for holding a multiplicity of brushes in a bath of fluid, so that the brush fibers are maintained in a soft and correctly shaped condition.

All of the above inventions have the disadvantage of requiring the availability of a relatively large, sturdy, and empty container.

Another disadvantage is that these large containers would require considerable amounts of cleaning fluid to fill them to a sufficient depth for the necessary brush fiber immersion.

None of these inventions would be practical for cleaning several paint brushes with different paint colors and paint bases simultaneously, as they all use only one container of solvent at a time. For example, brushes with strongly died paint would contaminate ones with white paint. Brushes using water and oil base paint could not be cleaned together.

OBJECTS OF THE INVENTION

It is the object of this invention to provide a rack in which one or more cups for containing cleaning fluid, can be detachably mounted. Said cups may be purchased at a reasonable price, and stacked in a compact package, so that they are easy to store, readily available, and can be economically disposed of after each use and replaced with clean ones.

It is also an object that the cups shall be shaped to accomodated the brush fibers with space for just enough solvent to soak them effectively, so that solvent can be used sparingly. It is also an object that brushes can be adjustably mounted to allow a gap for paint sludge to collect on the bottom of the cup without touching their fibers.

It is a further object that several brushes with different paint may be cleaned simultaneously in separate cups.

BRIEF SUMMARY OF THF INVENTION

In accordance with the present invention a free standing base, shaped to include an elongated trough, is provided. A member attached to the rear of said base, supports a rail offset above said trough and parallel to it. Said rail is provided with means for adjustably retaining paint brushes by their handles and suspending them vertically.

Thin plastic cups are provided which are shaped to nest in said trough, so that the fibers of said suspended brush can be immersed in a bath of cleaning fluid contained in said cup, once the cup and brush are mounted in line in said rack. Several cups and brushes can be mounted side by side. When the brushes have been cleaned, the dirty cups can be removed from the base, disposed of, and replaced with clean cups.

Other objects and advantages of the present invention will be apparent and suggest themselves to those skilled in the art, from a reading of the following specification and claims taken in conjunction with the accompanying drawings.

DESCRIPTION OF THE INVENTION

Figure 1:
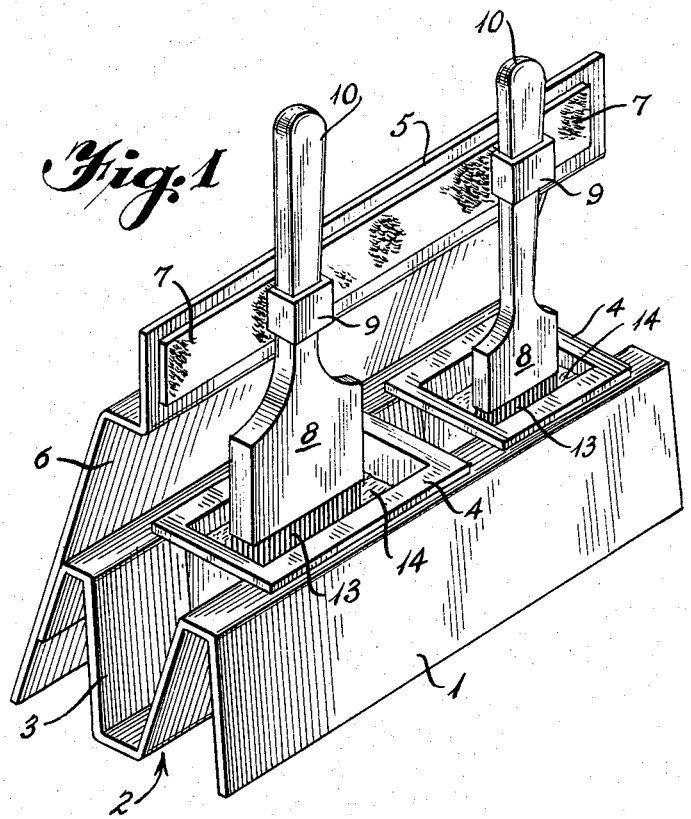
FIG. 1 is an isometric view of the paint brush rack with two cups and two brushes mounted in place.

Referring to FIG. 1 in a preferred embodiment a rack 1 is contructed with a free standing base 2, including an elongated trough 3, so that thin plastic cups 4 which are dimensioned to nest in said trough 3 are removably retained.

A horizontal rail 5 is offset above said base 2 and attached to said base 2 by means of an upright flange 6. The rail 5 is provided with a strip of hooked material 7, attached along its length.

Brushes 8 have a small band of looped material 9 attached to their handle 10. By pressing the handle's looped material 9 against the rail's hooked material 7, the brushes 8 can be detachably mounted on the rail 5 and their fibers 13 suspended to a desired depth in the cups 4 which are provided with cleaning fluid 14.

When the brushes 8 have been soaked for a sufficient period of time they can be removed from the rack 1 and the cups 4 can be disposed of and replaced with clean ones.

Figure 2:
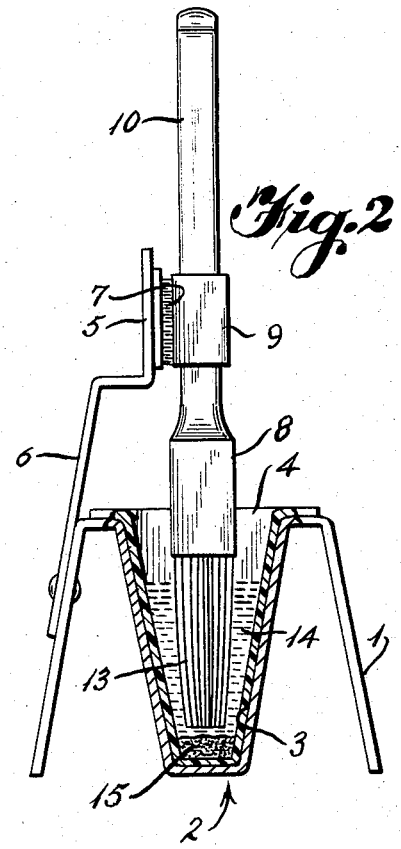
FIG. 2 is a side elevation view of the rack as illustrated in FIG. 1.

In FIG. 2 it can be seen that the cross section of the cup 4 has a shape which matches the cross section of the trough 3 for proper nesting and retention of said cup 4. The cross section of the cup 4 is also shaped to accept the profile of the brush fibers 13 with just enough room surrounding them for adequate, though economical use of cleaning fluid 14, and room for the paint sludge 15 to collect at the bottom of the cup 4 without touching the brush fibers 13.

The cups 4 are shaped with converging sides 16 and similarily converging ends, so they can be stacked and packaged compactly.

Figure 3:
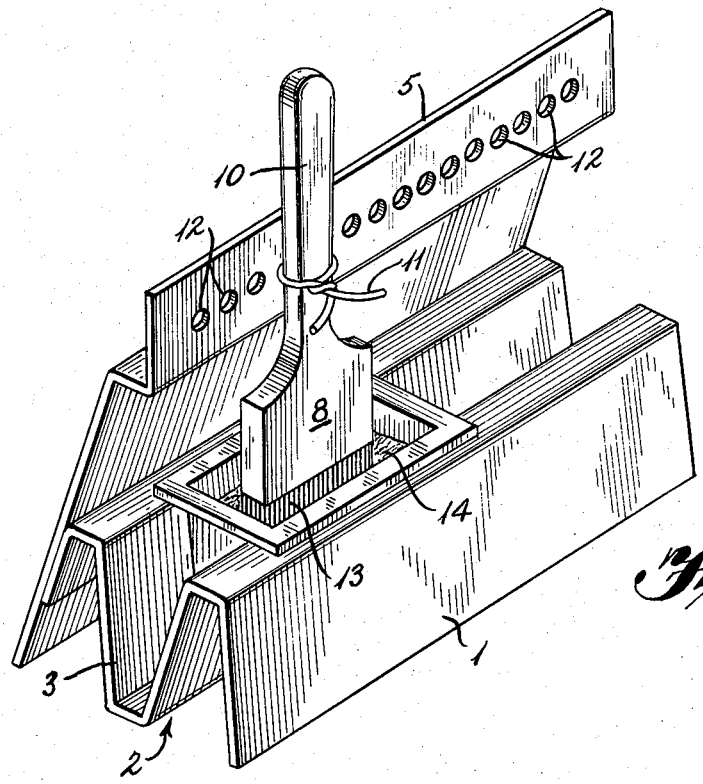
FIG. 3 is an isometric view of the rack illustrated in FIGS. 1 and 2, with a tie wrap arrangement for retaining brushes.
Figure 4:
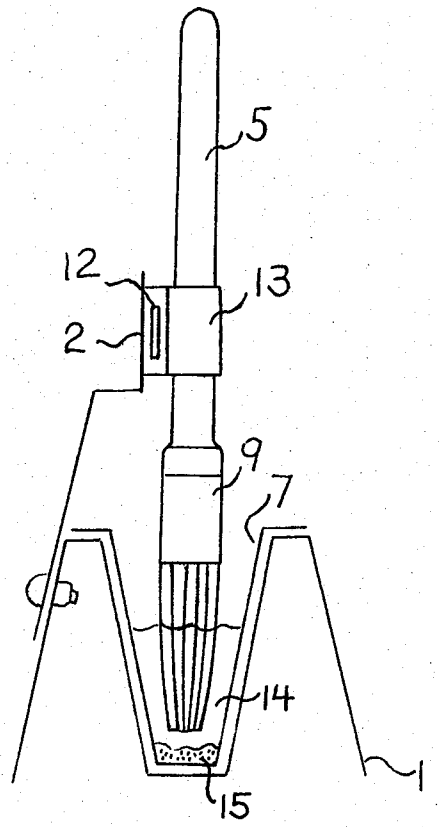
Figure 3:
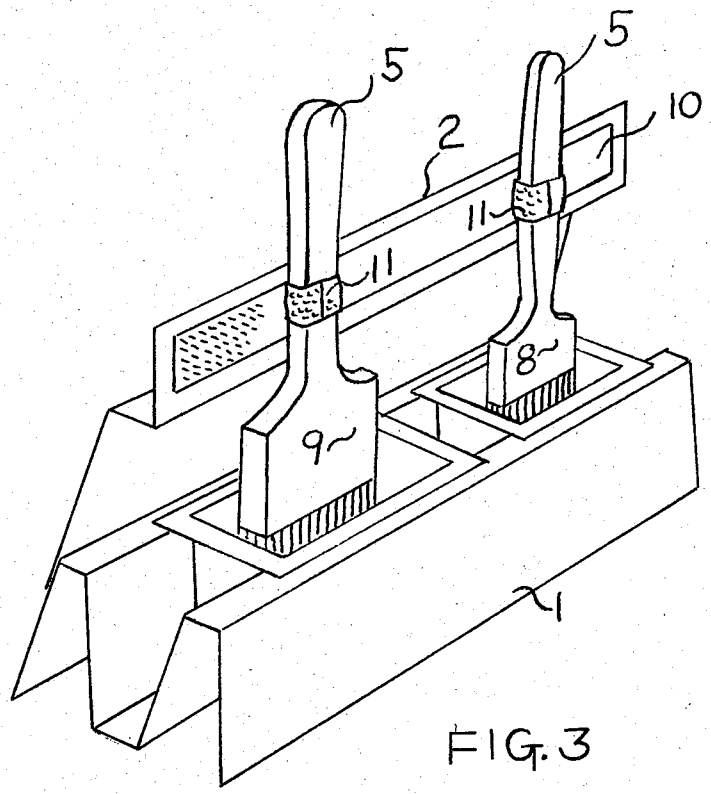

Referring to FIG. 3, another embodiment of the rack 1 is shown with a brush retaining means comprising a flexible plastic covered wire 11. The mounting rail 5 is provided with a multiplicity of perforated holes 12 along its length, and the brush 8 is mounted by wrapping said wire 11, which has been looped through an appropriately located pair of holes 12 on the rail 5, around the brush handle 10.

Thus it can be seen that the present invention provides a rack for suspending one or more paint brushes in one or more cups containing cleaning fluid and that said cups which can be stacked and packaged compactly, can be reasily available and economically disposed of after each use.

What is claimed is:

1. A rack for cleaning paint brushes comprising:

(a) a horizontally elongated, free standing base, said base including cup retaining means for retaining at least one horizontally elongated cup;

(b) at least one horizontally elongated cup removably supported in said cup retaining means;

(c) paint brush holding means mounted on said base extending upwardly thereof, an offset portion of said paint brush holding means located directly above said cup retaining means when said holding means is mounted on said base, said offset portion provided with paint brush mounting means for holding a paint brush in a vertical position;

whereby at least one paint brush may be suspended from said paint brush mounting means to a desired depth in said cup.

2. A rack as claimed in claim 1 wherein said horizontally elongated cup for said rack comprises longer sides and shorter ends, said sides and ends respectively converging toward one another to provide a form allowing a plurality of said cups to be stacked one within another.

3. A rack as claimed in claim 1 wherein said cup retaining means in said base comprises an elongated trough having converging sides, so that a cup with similar converging sides can nest and be retained in said trough.

4. A rack as claimed in claim 1 wherein said brush holding means comprises two materisls, a surface of each material covered with a pile of hook or loop projections, such that said surfaces will engage each other when brought together, one of said materials fixedly attached to said brush and the other fixedly attached to said rack.

5. A rack as claimed in claim 1 wherein said brush holding means comprises a rail with a multiplicity of perforations, and at least one flexible tie, said tie being looped through said perforations and the free ends of said tie wrapped around and twisted over the handle of said brush.

* * * * *